US005735727A

United States Patent [19]

Tsai

[11] Patent Number: 5,735,727

[45] Date of Patent: Apr. 7, 1998

[54] TRANSMISSION MECHANISM OF TOY CAR

[76] Inventor: Wen Ho Tsai, 8FL, No. 113, Yu Jen Rd., Taipei, Taiwan

[21] Appl. No.: 687,300

[22] Filed: Jul. 25, 1996

[51] Int. Cl.[6] ..... A63H 29/00

[52] U.S. Cl. ..... 446/462; 446/437; 446/470; 446/487

[58] Field of Search ..... 446/457, 462, 446/465, 470, 487, 437

[56] References Cited

U.S. PATENT DOCUMENTS

| | | | |
|---|---|---|---|
| 5,139,456 | 8/1992 | Chuang | 446/236 |
| 5,474,486 | 12/1995 | Chilton et al. | 446/470 |
| 5,542,872 | 8/1996 | Ho | 446/437 |
| 5,586,924 | 12/1996 | Huang | 446/470 |
| 5,641,317 | 6/1997 | Huang | 446/232 |

*Primary Examiner*—Robert A. Hafer
*Assistant Examiner*—Jeffrey D. Carlson
*Attorney, Agent, or Firm*—Pro-Techtor International

[57] ABSTRACT

A transmission mechanism of a toy car, including a housing in which a power source is disposed. The power source is drivingly connected to a first and a second cams via a gear set. A slidable pressing/pushing slide board and a driving slide board are respectively pushed by the first and second cams to slide. The driving slide board further drives a linkage set to upward pivot a movable casing cover open or close the movable casing cover. A decorative body is disposed on inner side of the movable casing cover, whereby when the movable casing cover is upward opened, the decorative body is exhibited to create a visual entertaining effect. The pressing/pushing slide board can depress a rotary power wheel set and make the same descend and contact with the ground, enabling the toy car to run over the ground and create a live versatile entertaining effect.

8 Claims, 5 Drawing Sheets

TRANSMISSION MECHANISM OF TOY CAR

BACKGROUND OF THE INVENTION

The present invention relates to a transmission mechanism of a toy car in which a rotary power wheel set is disposed under the bottom of the car. A pressing/pushing slide board is driven by a cam to depress the rotary power wheel set and make the same descend and contact with the ground, enabling the toy car to run over the ground. A decorative body is disposed on inner side of a movable casing cover pivotally disposed on the top of the toy car, whereby when the movable casing cover is upward opened, the decorative body is exhibited to create a visual entertaining effect.

Some of the conventional electric toy cars are designed with attractive appearances and simple movements. Most of these toy cars can run over the ground and turn about itself. While creating a monotonous sound/light effect, such toy cars cannot present versatile movements and thus can hardly satisfy the curiosity of children. Some other toy cars are designed with more versatile movements. Such toy cars always include complicated transmission mechanisms which are subject to failure after a period of use. Moreover, such complicated transmission mechanisms are manufactured at high cost so that the prices of these toy cars are relatively high and can be hardly widely accepted by general consumers. Therefore, it is necessary to provide a toy car which is manufactured at low cost, while being able to durably present versatile movements and create entertaining effect.

SUMMARY OF THE INVENTION

It is a primary object of the present invention to provide a transmission mechanism of a toy car, including a power source drivingly connected to a first and a second cams via a gear set. A slidable pressing/pushing slide board and a driving slide board are respectively pushed by the first and second cams to slide. The driving slide board further drives a linkage set to upward pivot a movable casing cover open to exhibit a decorative body disposed on inner side thereof or close the movable casing cover. The pressing/pushing slide board can depress a rotary power wheel set and make the same descend and contact with the ground, enabling the toy car to run over the ground and create a live versatile entertaining effect.

The present invention can be best understood through the following description and accompanying drawings, wherein:

DETAILED DESCRIPTION OF THE PREFERRED EMBODIMENT

Figure 1:
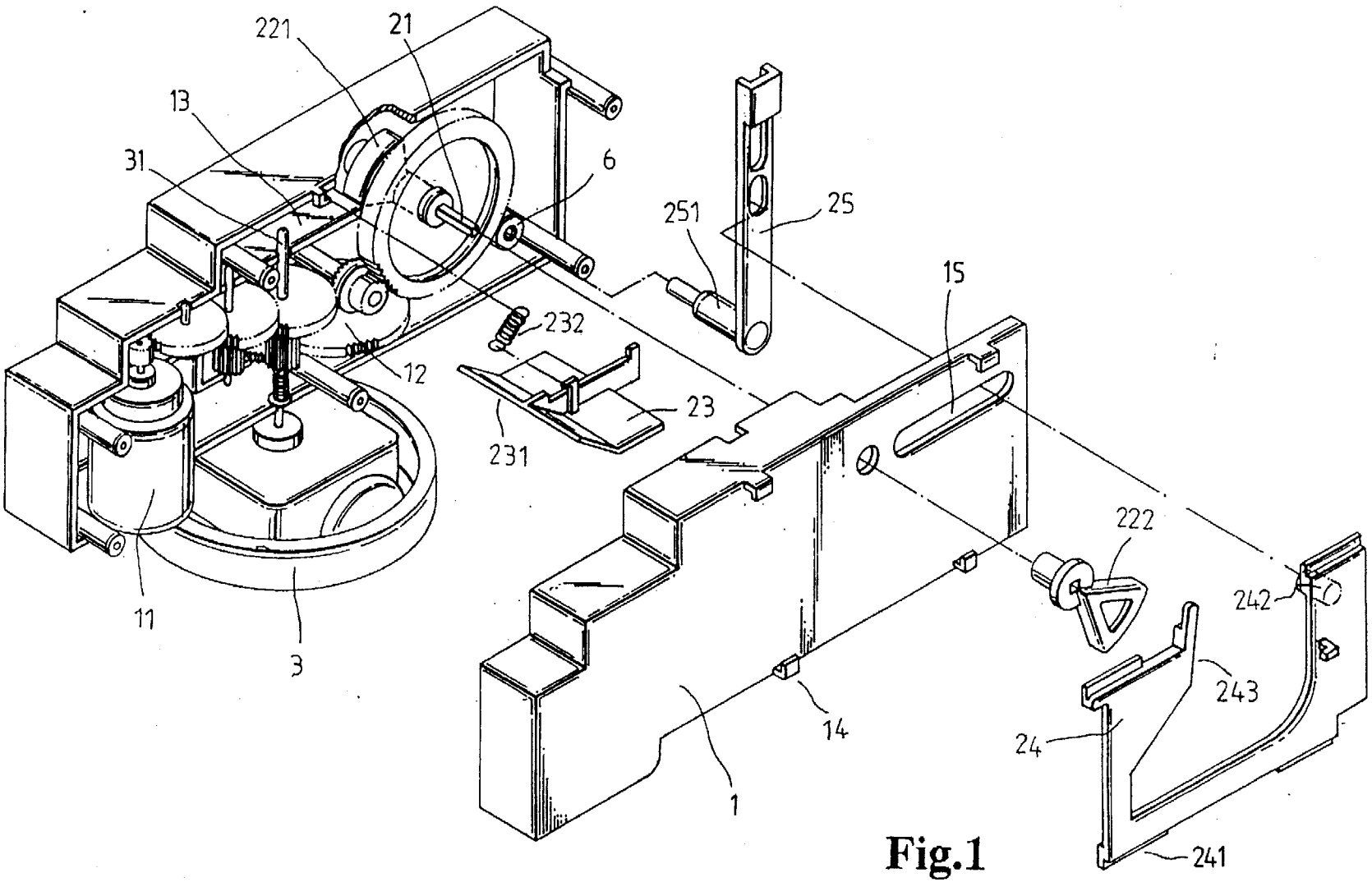
FIG. 1 is a perspective exploded view of the present invention.
Figure 2:
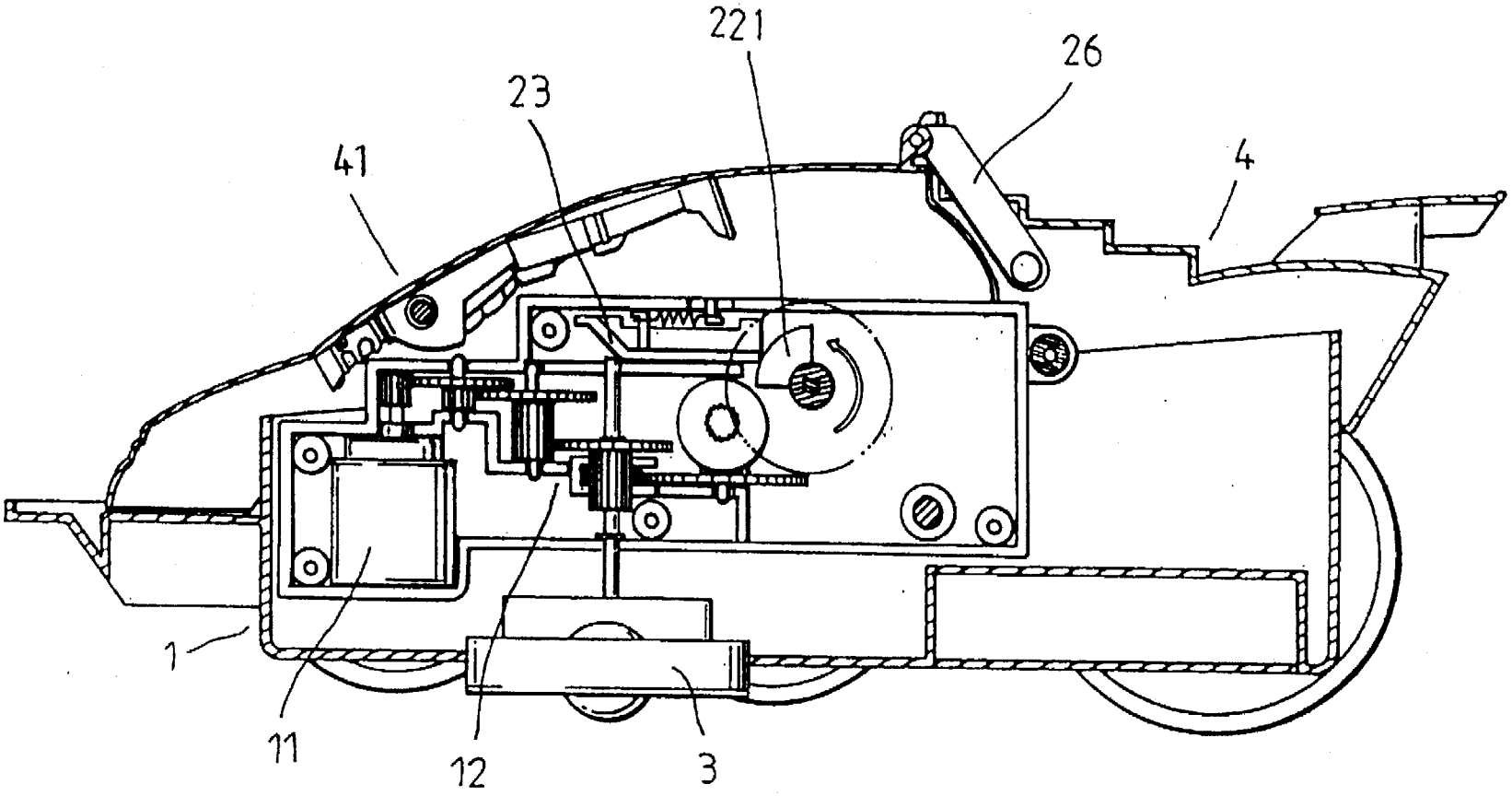
FIG. 2 is a side sectional view showing the ascending/descending movement of the rotary power wheel set of the present invention in a first state.
Figure 3:
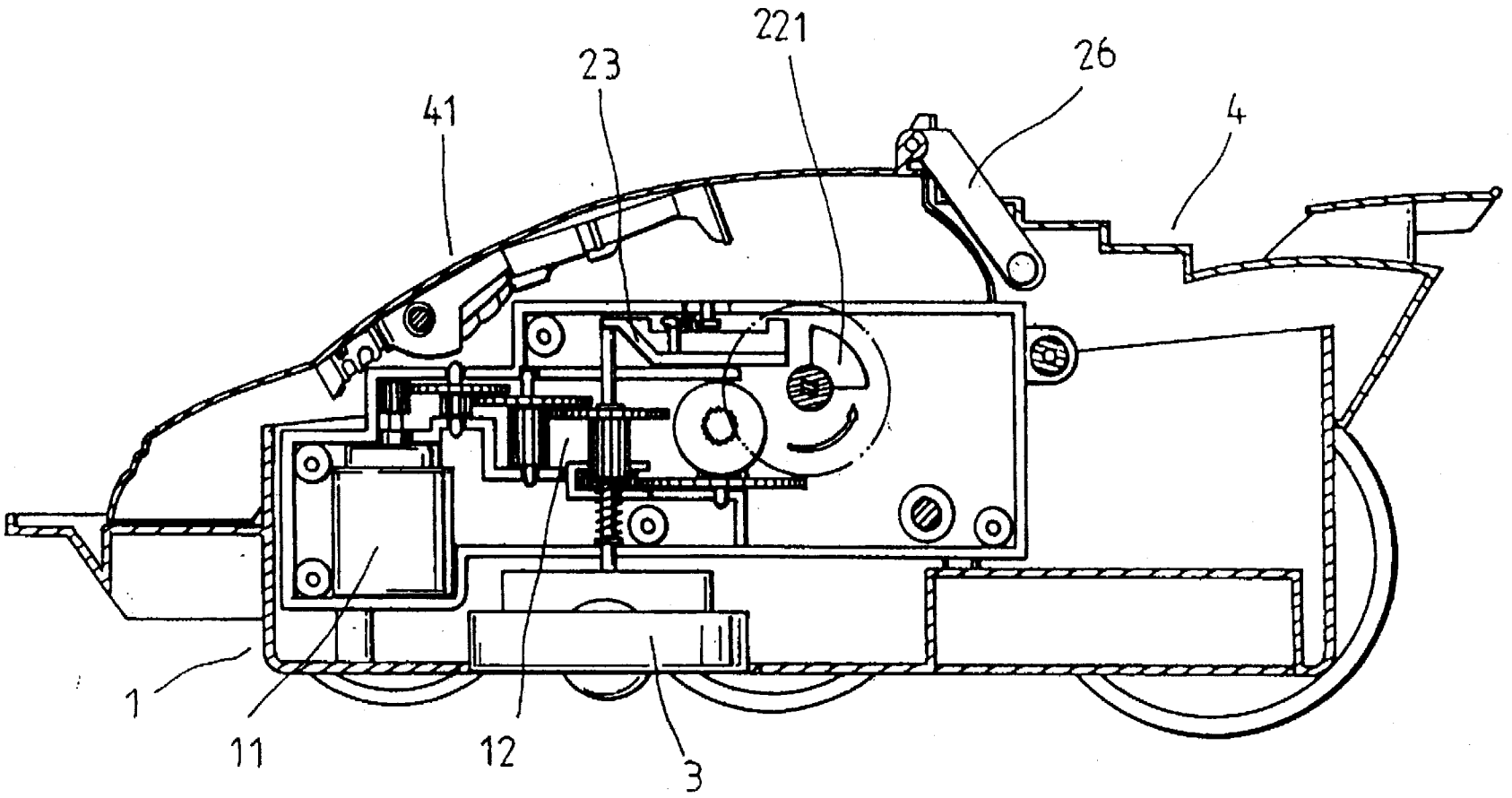
FIG. 3 is a side sectional view showing the ascending/descending movement of the rotary power wheel set of the present invention in a second state.
Figure 4:
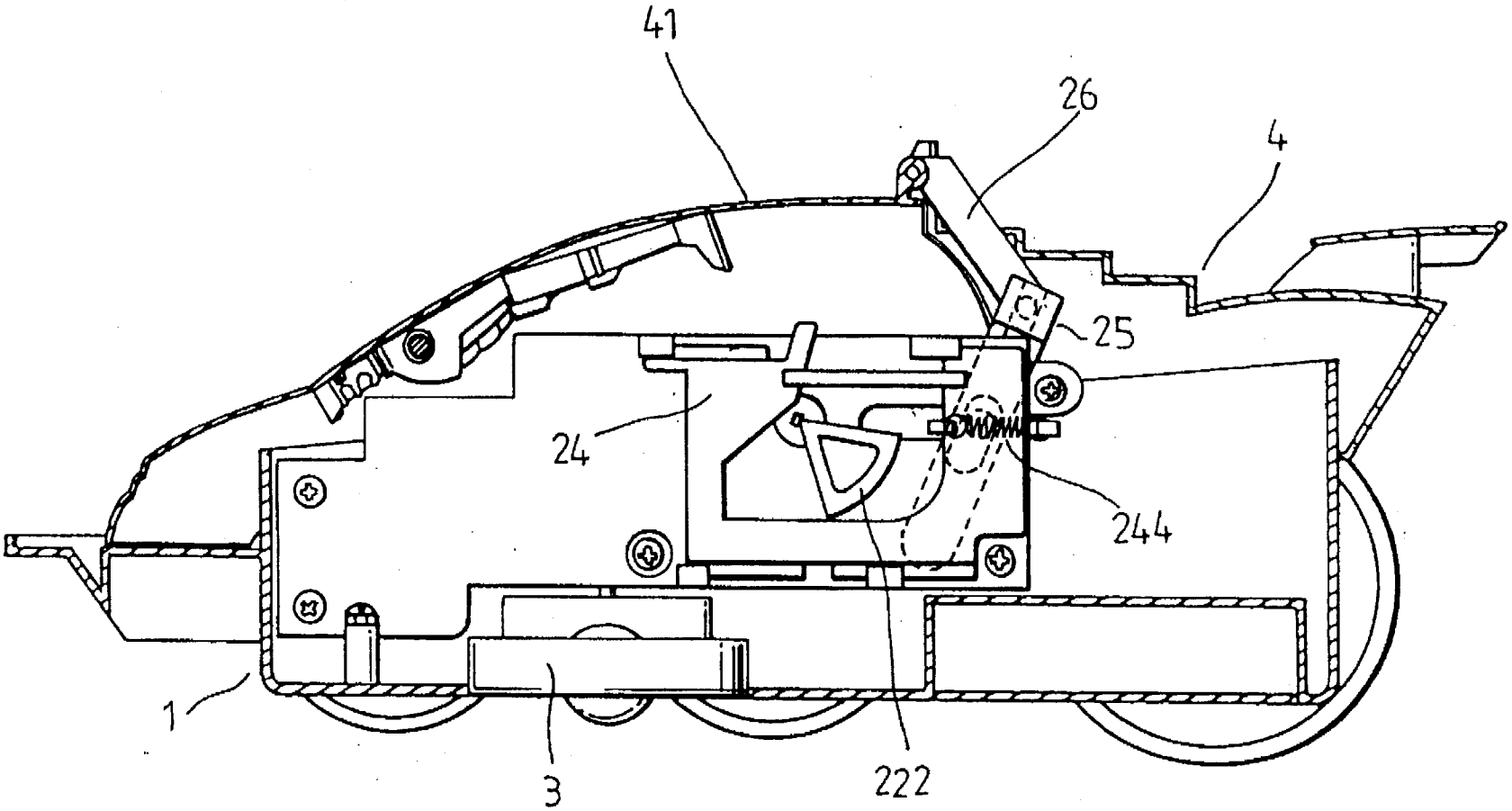
FIG. 4 is a side sectional view showing the movement of the movable casing cover of the present invention in a first state.
Figure 5:
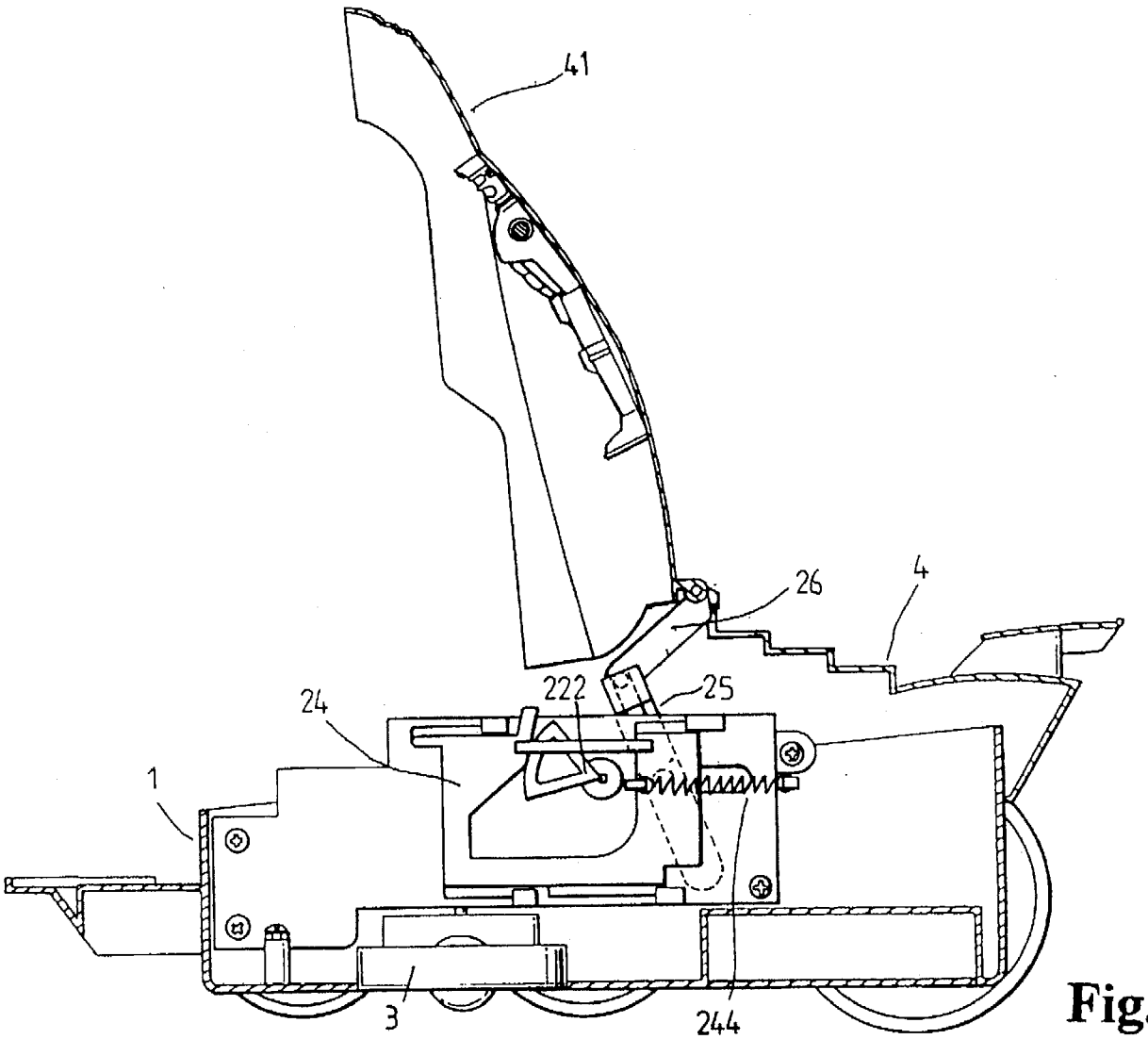
FIG. 5 is a side sectional view showing the movement of the movable casing cover of the present invention in a second state.

Please refer to FIGS. 1 to 5. The present invention includes a housing 1, a driving mechanism 2 and a rotary power wheel set 3. A power source 11 (such as a motor) and a linkage support seat 16 are respectively disposed in two ends of the housing 1. The power source 11 is connected to a gear set 12. A pressing/pushing guide channel 13 is formed on inner upper side of the housing 1. Multiple hook boards 14 are disposed on an outer lateral side of the housing 1. A transverse driving guide slot 15 is formed between the hook boards 14. The driving mechanism 2 includes a driving shaft 21 for outputting the power transferred from the gear set 12. A first and a second cams 221, 222 are respectively disposed on two sides of the gear set 12 in a state of reverse phase. The first cam 221 abuts against an end portion of a pressing/pushing slide board 23 inserted in the pressing/pushing guide channel 13 of the housing 1. A middle section of the pressing/pushing slide board 23 is hooked and retained by a spring 232 on the housing 1. The other end portion of the pressing/pushing slide board 23 is disposed with an upward inclined pressing face 231. The second cam 222 is disposed on an outer side of the housing 1 for pushing an abutting edge 243 of a driving slide board 24. The top and bottom sides of the driving slide board 24 are respectively disposed with multiple outward projecting edges 241 for extending into the hook board 14 of the housing 1. The outer side of the middle section of the driving slide board 24 is hooked and retained by a spring 244 on the housing 1. The inner side thereof is disposed with a post 242 extending into the driving guide slot 15 of the housing 1 to connect with a middle section of a lower linkage 25. The bottom end of the lower linkage 25 is disposed with a pivot shaft 251 for inserting into the linkage support seat 16 of the housing 1. The top end of the lower linkage 25 is connected with an upper linkage 26 which is further pivotally connected with a movable casing cover 4. The top portion of the rotary power wheel set 3 is disposed with a rotary power wheel shaft 31 extending into the pressing/pushing guide channel 13 of the housing 1. The first cam 221 pushes the pressing/pushing slide board 23, while the spring 232 interactively pulls the pressing/pushing slide board 23 so that the pressing/pushing slide board 23 is reciprocally slidable within the pressing/pushing guide channel 13 of the housing 1. When the pressing/pushing slide board 23 is slided forward to a position above the rotary power wheel shaft 31, by means of the guiding of the inclined pressing face 231, the pressing/pushing slide board 23 can smoothly depress the rotary power wheel shaft 31 to make the rotary power wheel set 3 descend and contact with the ground as shown in FIG. 2. At this time, the rotary power wheel set 3 drives the housing 1 to run over the ground. After the first cam 221 continuously rotates and separates from the pressing/pushing slide board 23, the same is pulled by the spring 232 to slide rearward and the rotary power wheel shaft 31 drives the rotary power wheel set 3 to ascend and separate from the ground and restore to its home position as shown in FIG. 3. At this time, the housing 1 stops running. The abutting edge 243 of the driving slide board 24 is pushed By the second cam 222 and hooked and retained by a spring 244 on one side of the housing 1 and is reciprocally slidable in the hook board 14. The post 242 can snugly slide within the driving guide slot 15 to drive the lower linkage 25 to reciprocally swing about the pivot shaft 251. In the case that the second cam 222 does not abut against the abutting edge 243, the driving slide board 24 is pulled by the spring 244 and located at the end of the housing 1. At this time, the lower linkage 25 and the upper linkage 26 are retracted and the movable casing cover 41 and the outer casing cover 4 are closed as shown in FIG. 4. When the second cam 222 abuts against the abutting edge 243 of the driving slide board 24, the driving slide board 24 slides forward in the hook board 14. At this time, the lower linkage 25 is pulled by the post 242 to swing, while the upper linkage 26 is simultaneously pulled to abut against the movable casing cover 41. The other end of the movable casing cover 41 is upward opened as shown in FIG. 5 to exhibit a decorative body hidden in bottom side of the movable casing cover 41.

The present invention operates in such a manner that the power source 11 drives the driving shaft 21 to drive the first and second cams 221, 222 to rotate in reverse phase. When the first cam 221 pushes the pressing/pushing slide board 23, the same can slide forward within the pressing/pushing guide channel 13 of the housing 1. By means of the guiding of the inclined pressing face 231, the pressing/pushing slide board 23 can depress the rotary power wheel shaft 31 to make the rotary power wheel set 3 descend and contact with the ground. At this time, the rotary power wheel set 3 drives the housing 1 to run over the ground. After the first cam 221 continuously rotates and separates from the pressing/pushing slide board 23, the same is pulled by the spring 232 to slide rearward and the rotary power wheel shaft 31 drives the rotary power wheel set 3 to ascend and separate from the ground and restore to its home position. At this time, the housing 1 stops running and the second cam 222 pushes the driving slide board 24 to slide forward in the hook board 14. The driving slide board 24 then drives the lower linkage 25 to reciprocally swing about the pivot shaft 251. The upper linkage 26 is simultaneously pulled by the lower linkage 25 to abut against and upward open the movable casing cover 41 so as to exhibit the decorative body hidden in the bottom side thereof.

It should be noted that the above description and accompanying drawings are only used to illustrate some embodiments off the present invention, not intended to limit the scope thereof. Any modification of the embodiments should fall within the scope of the present invention.

What is claimed is:

1. A transmission mechanism of a toy car, comprising:

a housing in which a power source is disposed, the power source being drivingly connected to a first and a second cams via a gear set;

a driving mechanism composed of a slidable pressing/pushing slide board and a driving slide board which are respectively pushed by the first and second cams to slide, the driving slide board further driving a linkage set connected with a movable easing cover to swing; and a rotary power wheel set having a rotary power wheel shaft on top side for extending into a sliding path of the pressing/pushing slide board, a gear being disposed around the rotary power wheel shaft for engaging with the gear set, whereby the pressing/pushing slide board depresses the rotary power wheel shaft, making the rotary power wheel set descend and contact with the ground to run over the ground and whereby the driving slide board drives the linkage set to swing and upward push open the movable casing cover.

2. A transmission mechanism as claimed in claim 1, wherein the housing is formed with an inner pressing/pushing guide channel for the pressing/pushing slide board to extend and slide therein.

3. A transmission mechanism as claimed in claim 1, wherein multiple opposite hook boards are disposed on lateral sides of the housing for a projecting edge of the driving slide board to extend and slide therein.

4. A transmission mechanism as claimed in claim 1, wherein an inclined pressing face is disposed on one side of the pressing/pushing slide board for guiding the pressing/pushing slide board to smoothly depress the rotary power wheel shaft.

5. A transmission mechanism as claimed in claim 1, wherein the driving slide board has a post inserted in a middle section of a lower linkage of the linkage set for driving the same to swing.

6. A transmission mechanism as claimed in claim 1, wherein each of the pressing/pushing slide board and the driving slide board is connected with the housing via a resilient member, whereby when the two cams stop pushing the pressing/pushing slide board and the driving slide board, the same are restored to their home positions by the resilient members.

7. A transmission mechanism as claimed in claim 1, wherein one end of the movable casing cover is pivotally disposed on an outer casing cover enclosing the housing, whereby when the movable casing cover is pushed by the linkage set, the other end of the movable casing cover is pivoted open.

8. A transmission mechanism as claimed in claim 1, wherein a decorative body is hidden on inner side of the movable casing cover, whereby when the movable casing cover is upward opened, the decorative body is exhibited.

* * * * *